US006302106B1

(12) United States Patent
Lewis

(10) Patent No.: US 6,302,106 B1
(45) Date of Patent: Oct. 16, 2001

(54) REBREATHER SYSTEM WITH OPTIMAL PO2 DETERMINATION

(76) Inventor: John E. Lewis, 4524 Palos Verdes Dr. East, Rancho Palos Verdes, CA (US) 90275

( * ) Notice: Subject to any disclaimer, the term of this patent is extended or adjusted under 35 U.S.C. 154(b) by 0 days.

(21) Appl. No.: 09/222,046

(22) Filed: Dec. 29, 1998

Related U.S. Application Data

(62) Division of application No. 08/897,092, filed on Jul. 18, 1997, now Pat. No. 5,924,418.

(51) Int. Cl.[7] ..... A61M 16/00

(52) U.S. Cl. ..... 128/204.22; 128/204.29; 128/201.27

(58) Field of Search ..... 128/201.27, 205.28, 128/204.26, 204.29, 205.11, 914, 204.22

(56) References Cited

U.S. PATENT DOCUMENTS

| | | | | |
|---|---|---|---|---|
| 3,252,458 | | 5/1966 | Krasberg . | |
| 3,524,444 | | 8/1970 | Ellard et al. . | |
| 3,593,735 | | 7/1971 | Reiher . | |
| 3,672,388 | | 6/1972 | Ringwall et al. . | |
| 3,695,261 | | 10/1972 | Emmons . | |
| 3,710,553 | * | 1/1973 | Parker et al. | 128/205.28 |
| 3,727,626 | | 4/1973 | Kanwisher et al. . | |
| 3,794,059 | | 2/1974 | Burt, Jr. . | |
| 3,802,427 | | 4/1974 | Banjavich et al. . | |
| 3,957,043 | | 5/1976 | Shelby . | |
| 4,056,098 | | 11/1977 | Michel et al. . | |
| 4,236,546 | | 12/1980 | Manley et al. . | |
| 4,454,878 | | 6/1984 | Morrison . | |
| 4,776,332 | * | 10/1988 | Wenzel et al. | 128/204.29 |
| 4,876,903 | | 10/1989 | Budinger . | |
| 4,939,647 | | 7/1990 | Clough et al. . | |
| 4,964,404 | | 10/1990 | Stone . | |
| 4,974,585 | | 12/1990 | Stone . | |
| 5,036,841 | | 8/1991 | Hamilton . | |
| 5,127,398 | | 7/1992 | Stone . | |

(List continued on next page.)

FOREIGN PATENT DOCUMENTS 1342155 12/1973 (GB) .

OTHER PUBLICATIONS

Devon, *Closed–Cycle Breathing System Extends Diving Time*, Designs in the News, Jul. 21, 1969, pp. 14–15.
Dräger *Atlantis I Rebreather* brochure (1 Page).
Dräger *Dive* brochure (15 Pages).
Gilliam, Bret, "*Affordable Rebreathers, Finally*" (15 minutes with Bret Gilliam, CEO of UWATEC, USA) Deep-Tech—Issue 7, pp. 54–57.
UWATEC *Atlantis* brochure (1 Page).

*Primary Examiner*—Glenn K. Dawson
(74) *Attorney, Agent, or Firm*—Christie, Parker & Hale, LLP

(57) ABSTRACT

A method and apparatus for a self contained underwater breathing apparatus in which a breathing gas is supplied to a flow loop from two separate gas sources each having a different oxygen fraction, and each controlled by separate mass flow controllers having variable flow rate. The mass controller flow rates are adaptively adjustable to deliver gas at variable flow rates which depend solely on a function of depth. An algorithm determines these specific flow rates from each of the tanks at particular depths, such that the gas flow from an oxygen rich gas source decreases as a function of depth, while the gas flow from a diluent gas source increases as a function of depth, so as to maintain the oxygen partial pressure in the flow loop within a specific predetermined range. The algorithm allows calculation of an optimum oxygen partial pressure, for a particular dive, which allows construction of a dive profile which maximizes bottom time while taking into account no-decompression time at depth, tank capacity limited time, and single-dive and daily pulmonary oxygen toxicity limits.

13 Claims, 9 Drawing Sheets

U.S. PATENT DOCUMENTS

| | | | | |
|---|---|---|---|---|
| 5,368,018 | | 11/1994 | Stone . | |
| 5,368,020 | * | 11/1994 | Beux | 128/205.28 |
| 5,503,145 | | 4/1996 | Clough . | |
| 5,806,514 | * | 9/1998 | Mock et al. | 128/201.27 |
| 5,924,418 | * | 7/1999 | Lewis | 128/204.22 |
| 6,003,513 | * | 12/1999 | Readey et al. | 128/205.28 |

* cited by examiner

REBREATHER SYSTEM WITH OPTIMAL PO2 DETERMINATION

CROSS-REFERENCE TO RELATED APPLICATIONS

This application is a division of patent application Ser. No. 08/897,092, filed Jul. 18, 1997, now U.S. Pat. No. 5,924,418.

FIELD OF THE INVENTION

The present invention relates generally to diving systems and more particularly to closed circuit and semi-closed circuit rebreathers having two separate gas sources with variable delivery rates for controlling the oxygen partial pressure of the breathing mixture and for maximizing dive and minimizing decompression times.

BACKGROUND OF THE INVENTION

Traditionally, self-contained underwater breathing apparatuses can be viewed as falling into two general categories; open circuit and closed or semi-closed circuit. Open circuit systems are typically recognized by the common term SCUBA and represent the most commonly used form of underwater breathing apparatus. Developed and popularized by Jacques Cousteau, open circuit scuba apparatus generally comprises a high pressure tank filled with compressed air, the tank coupled to a demand regulator which supplies the breathing gas to for example, a diver, at the diver's ambient pressure, thereby allowing the user to breathe the gas with relative ease.

Conventional open circuit self contained diving systems are very well understood in the art and have been developed over the past several years into a wide variety of gas delivery systems, configured for an equally wide variety of applications. For example, compressed air is used as a breathing gas in typical sport diving applications, while one or more artificial mixtures of gasses might comprise the breathing mixture for diving operations at depths greater than approximately 50 meters (150 feet).

While open circuit scuba apparatus is relatively simple, at least in its compressed air form, the equipment required is bulky, heavy and the design itself is inherently inefficient in its use of the breathing gas. Each exhaled breath is expelled to the surrounding environment, thus wasting all the oxygen which was not absorbed by the user during the breath. This inefficiency in breathing gas utilization normally requires a diver to carry a large volume of breathing gas, in order to obtain a reasonable dive time. For example, conventional open circuit scuba gear typically includes compressed air tanks having gas volumes of about 80 cubic feet, and which weigh over 40 lbs.

As a diver descends, the ambient pressure increases approximately one atmosphere for every 30 feet of depth as is well known. Accordingly, gas consumption increases rapidly with depth. As a diver proceeds below approximately 150 feet, the increasing ambient pressure and thus the increasing pressure of the breathing gas, causes serious physiological problems, such as nitrogen narcosis and oxygen toxicity, which may have even deadly effects.

In addition, even short duration dives at depths greater than 100 feet require a certain amount of decompression time which must be pre-calculated in order to ensure a sufficient volume of breathing gas remains after the dive in order to accommodate decompression. Accordingly, while relatively simple and inexpensive, open circuit scuba apparatus imposes a number of practical limitations on both depth and dive time as a consequence of its construction and configuration.

The most common type of open circuit SCUBA apparatus is depicted in FIG. 1 and is of the open circuit demand-type which utilizes compressed air tanks in combination with demand regulator valves which provide air from the tanks on demand from a diver 18 by the inhalation of air. A compressed air supply tank 10 is coupled to a first stage (high pressure) regulator 12 which conventionally including an on-off valve 11 which reduces the pressure of the air within the tank to a generally uniform low-pressure value suitable for use by the rest of the system. Low pressure air (approximately 150 psi) is delivered to a second stage regulator 14 through a demand valve 16 in conventional fashion. Compressed air, at the cylinder pressure, is reduced to the diver's ambient pressure in two stages, with the first stage reducing the pressure below the tank pressure, but above the ambient water pressure, and the second stage reducing the gas pressure to the surrounding ambient or water pressure. The demand valve is typically a diaphragm actuated, lever operated spring-loaded poppet which functions as a one-way valve, opening in the direction of air flow, upon movement of the diaphragm by a diver's inhalation of a breath.

The second form of self contained breathing apparatus is the closed circuit or semi-closed circuit breathing apparatus, commonly termed rebreathers. As the name implies, a rebreather allows a diver to "rebreathe" exhaled gas to thus make nearly total use of the oxygen content in its most efficient form. Since only a small portion of the oxygen a person inhales on each breath is actually used by the body, most of this oxygen is exhaled, along with virtually all of the inert gas content such as nitrogen and a small amount of carbon dioxide which is generated by the diver. Rebreather systems make nearly total use of the oxygen content of the supply gas by removing the generated carbon dioxide and by replenishing the oxygen content of the system to make up for that amount consumed by a diver.

Both types of rebreather systems mentioned above, comprise a certain few essential components; namely, a flow loop with valves to control the flow direction, a counterlung or breathing bag, a scrubber to absorb or remove exhaled $CO_2$, and some means to add gas to the counterlung as the ambient pressure increases. Valves maintain gas flow within the flow loop in a constant direction and a diver's lungs provides the motive power.

A typical semi-closed circuit rebreather system is illustrated in FIG. 2 and commonly comprises a compressed gas cylinder 20 conventionally including an on-off value 11 and first stage, high-pressure regulator 12, containing a specific gas mix having a predetermined fraction of oxygen. The gas is provided to a flow loop 22, generally implemented by flexible, gas impermeable hoses, which are coupled between the cylinder 20 and a flexible breathing bag 24, sometimes termed a counterlung. A pair of one-way check valves 26 and 28 are disposed in the flow loop such that the gas flow within the loop is maintained in a single direction (clockwise in the illustration of FIG. 2). An exhaled breath would thus enter the counterlung, increasing the pressure therein, and pass through one-way check valve 26 and move through some device means to remove excess carbon dioxide from the breathing gas, such as a $CO_2$ canister 30, and thereby return to the counterlung through one-way check valve 28. The check valves thus maintain the gas flow in a constant direction, while the diver's lungs move the gas through the $CO_2$ canister in the system. The gas mix is introduced into the flow loop at a flow rate calculated to maintain the oxygen needs of a particular diver during the dive. Gas is introduced to the flow loop at a constant fixed flow rate through a valve 32 coupled between the flow loop and the first stage regulator 12 of the gas cylinder 20. As the breathing gas mix is recirculated, some of the oxygen is necessarily consumed and $CO_2$ is absorbed, thus perturbing both the total volume and the mix of the gas. A portion of the oxygen is consumed during recirculation, so the diver necessarily breathes a mixture with a lower oxygen concentration than that of the gas mix. Since the amount of oxygen supplied to the system depends on a diver's activity level (oxygen consumption rate), care must be taken to take activity into account as well as selecting the gas mixture composition for a particular diving depth.

A more efficient type of rebreather system is the closed circuit rebreather, illustrated in simplified form in FIG. 3. Closed circuit rebreathers are generally more sophisticated and effective in their maintenance of oxygen levels in the flow loop. Nonetheless, they share common components with semi-closed circuit rebreather systems such as that depicted in FIG. 2. The main contrast between fully closed and semi-closed circuit rebreather systems is that the closed circuit rebreather, as configured, provides a source of pure oxygen to the flow loop and introduces oxygen to the recirculating gas in an amount ideally equal only to that consumed by a diver such that system mass is conserved. The oxygen level (more correctly the oxygen partial pressure) is monitored electronically by an oxygen sensor (34 in FIG. 3) whose output is evaluated by a processing circuit (36 of FIG. 3) which, in turn, controls an electrically operated solenoid valve so as to add oxygen to the system when the oxygen sensor indicates it is being depleted. It should be noted, that closed circuit rebreathers only introduce gas to the system when the oxygen sensor 34 indicates the need for additional oxygen or as ambient pressure increases during descent and the addition of diluent is required to prevent the collapse of the counterlung. Oxygen is added in "pulses" in contrast to the steady-state flow of the semi-closed circuit system and is required to be constantly monitored. Diluent from an optional diluent gas source (indicated in phantom in FIG. 3) is added by a demand valve in the counterlung that is activated as the counterlung collapses because of increasing ambient pressure.

It should likewise be noted that once a particular oxygen partial pressure has been established in a closed circuit rebreather system, this partial pressure of oxygen is maintained by operation of the oxygen sensor 34 and processing circuit 36, regardless of a diver's external environment, and any changes thereto.

Partial pressure of oxygen in a particular breathing gas mixture may be understood as the pressure that oxygen alone would have if the other gasses (such as nitrogen) were absent from the gas. The physiological effects of oxygen depend upon this partial pressure in the mix and serious consequences result from oxygen partial pressures that are too high; e.g., oxygen becomes increasingly toxic as the partial pressure increases significantly above the oxygen partial pressure found in air at sea level (0.21 atmospheres), as well as too low. Where the oxygen partial pressure is too low, a diver would not necessarily experience any discomfort or shortness of breath, and in many cases may not even be aware of the shortness of oxygen until unconsciousness is imminent. In a relatively short period of time, depending in turn on the volume of a counterlung, the diver would become unconscious and eventually die from hypoxia The diver would experience very little discomfort, and in fact may feel rather euphoric. This euphoria is a typical and characteristically dangerous aspect of hypoxia.

On the other hand, serious physiological effects may result from too much oxygen leading to various forms of what might be termed oxygen poisoning. There are several major forms of oxygen poisoning but two in particular have a bearing on the operational configuration of various rebreather systems; central nervous system toxicity (CNS) and pulmonary or whole-body oxygen poisoning. Almost any rebreather system that includes an oxygen supply component is capable of delivering excess oxygen to a diver. Excess oxygen is defined in this case as oxygen partial pressure greater than specific tolerable limits; the most important limit being that of CNS oxygen toxicity. CNS limits, which define the oxygen partial pressure levels that can be tolerated for various durations depending on the degree of oxygen excess, are defined in the 1991 National Oceanographic and Atmospheric Administration (NOAA) diving manual and are well understood by those skilled in the art. CNS poisoning becomes a significant consideration as the partial pressure of oxygen exceeds a generally accepted limit of 1.6 atmospheres. CNS toxicity gives rise to various symptoms, the most serious of which are convulsive seizures, similar to those experienced during an epileptic fit. These seizures generally last for about 2 minutes and are followed by a period of unconsciousness.

If a level of 1.6 atmospheres is not exceeded, then the concern becomes one of pulmonary or whole body toxicity rather than CNS. Pulmonary oxygen toxicity results from prolonged exposure to oxygen partial pressures above approximately 0.5 atmospheres and the consequences of excessive exposure include lung irritation, which may be reversible, and some lung damage which is not.

It will be apparent from the foregoing, that the partial pressure of oxygen in a breathing gas mixture should be kept to a value in the range of from about 0.21 atmospheres to about 1.6 atmospheres. Further, in the absence of pulmonary oxygen toxicity considerations, the optimum choice of the partial pressure of oxygen is the maximum value for which CNS toxicity poses no threat, i.e., 1.6 atmospheres. This is because maximizing the oxygen partial pressure to the highest practical limit has the effect of minimizing the diluent partial pressure and, minimizing diluent physiological uptake which leads to the need for decompression. Accordingly, to the extent that oxygen partial pressure is increased, decompression times are correspondingly decreased. However, for long duration dives or multiple repetitive dives, pulmonary oxygen toxicity (rather than CNS) presents additional limitations that could be avoided by a choice of a lower partial pressure of oxygen. This choice depends on well known pulmonary toxicity limitations, breathing gas tank capacity, and decompression considerations.

Thus, it will be seen that there is no one specific partial pressure of oxygen in a breathing gas that is optimal for all conditions at all depths. One set of factors would tend to indicate that a relatively higher partial pressure of oxygen is preferred, while another set of factors would tend to indicate that this is not always the case.

Typical of prior art systems is a mixed-gas, closed circuit rebreather disclosed in U.S. Pat. No. 4,939,647 to Clough et al. The Clough et al. system is based on a conventional Rexnord CCR 155-type closed circuit rebreather comprising a supply of compressed inert gas and a supply of oxygen in separate source bottles. Inert gas is fed into the system's breathing loop by a demand regulator in order to maintain a loop volume with increasing depth, while oxygen is added to the breathing loop as it is consumed by a diver. Oxygen partial pressure in the loop is electronically monitored and maintained to a pre-set level below the CNS threshold. The system includes three oxygen sensors, operating in a majority-vote configuration which provides the sensing function for determining oxygen partial pressure within the loop. Oxygen partial pressures are adjustable, depending on the dive profile chosen, but once a particular value has been pre-set, that value is maintained unless affirmatively readjusted. As a result, the Clough et al. system results in unnecessary restrictions in a dive profile.

Similar rebreather systems are described in U.S. Pat. No. 3,727,626 to Kanwisher et al. and U.S. Pat. No. 4,236,546 to Manley et al. The systems described are both closed circuit-type rebreathers that include electronics for maintaining oxygen partial pressures in a breathing loop at a specific, pre-set value.

The net result of a pre-set value of $PO_2$ can result in a reduction of dive time and an increase in unproductive decompression times. The objective of the present invention is to prevent these limitations.

SUMMARY OF THE INVENTION

A semi-closed circuit rebreather system in accordance with the present invention, provides a breathing gas mix to a diver in accordance with flow rates that maintain oxygen partial pressures within a specific, pre-set range, where the flow rates are determined solely as a function of the surrounding ambient pressure (depth). The semi-closed circuit rebreather system comprises an oxygen rich gas source and a diluent gas source, configured to provide a breathing gas mix to a flow loop including a counterlung. The oxygen rich and diluent gas sources each comprise a particular, different, oxygen fraction, and first and second flow control valves are coupled between the gas sources and the flow loop. Each flow control valve has a variable flow rate and adaptively adjusts the flow rate of its respective gas source so as to maintain partial pressure of oxygen within the counterlung within the pre-determined range, solely as a function of depth.

In one aspect of the invention, the oxygen rich gas source comprises pure oxygen having an oxygen fraction of 1.0. The diluent gas source comprises compressed air, having an oxygen fraction of 0.21. Flow rates of the oxygen and air sources are adaptively adjusted as a function of depth in accordance with an algorithm defined in terms of minimum and maximum oxygen consumption rates, minimum and maximum oxygen partial pressures, the oxygen fraction of the oxygen rich and diluent gas sources, and depth. Oxygen consumption, fraction, and partial pressure are predetermined; depth provides the only variable, such that the algorithm defines flow rates solely in terms of depth.

In yet a further aspect of the present invention, a closed circuit rebreather system is disclosed and includes an oxygen sensor, coupled to a signal processing circuit, capable of receiving an ambient pressure signal from the sensor, and providing control signals to flow valves to maintain oxygen partial pressure at a specific value determined in accordance with an analysis of tank capacity, no-decompression time at depth, and pulmonary toxicity limits to construct a dive profile giving maximum dive time. Optimal solutions for oxygen partial pressure are calculated in accordance with an algorithm which equates a pulmonary toxicity time limit to a tank capacity time limit, with a no-decompression time at depth providing an outer bound. In accordance with the invention, specific oxygen partial pressure values e.g., 0.5 and 1.6, are chosen as limiting values.

BRIEF DESCRIPTION OF THE DRAWINGS

These and other features, aspects and advantages of the present invention will be more fully understood when considered with respect to the following detailed description, appended claims, and accompanying drawings, wherein:

DETAILED DESCRIPTION OF THE INVENTION

Flow Rate Determination

The primary limitation of conventional semi-closed rebreather systems lies in the fact that the flow loop and counterlung are supplied with breathing gas comprising a fixed oxygen proportion supplied at a constant mass flow. As is well understood by those having skill in the art, since the breathing gas mixture is provided with fixed proportions, the oxygen partial pressure of the supplied gas will necessarily increase with depth. Accordingly, it is necessary for a diver to strictly limit his depth in order to avoid the risk of Central Nervous System (CNS) oxygen toxicity, which occurs for oxygen partial pressures in excess of 1.6 atmospheres. Constant mass flow semi-closed circuit rebreather systems deliver gas at a much greater rate than necessary at shallow depths.

Figure 4:
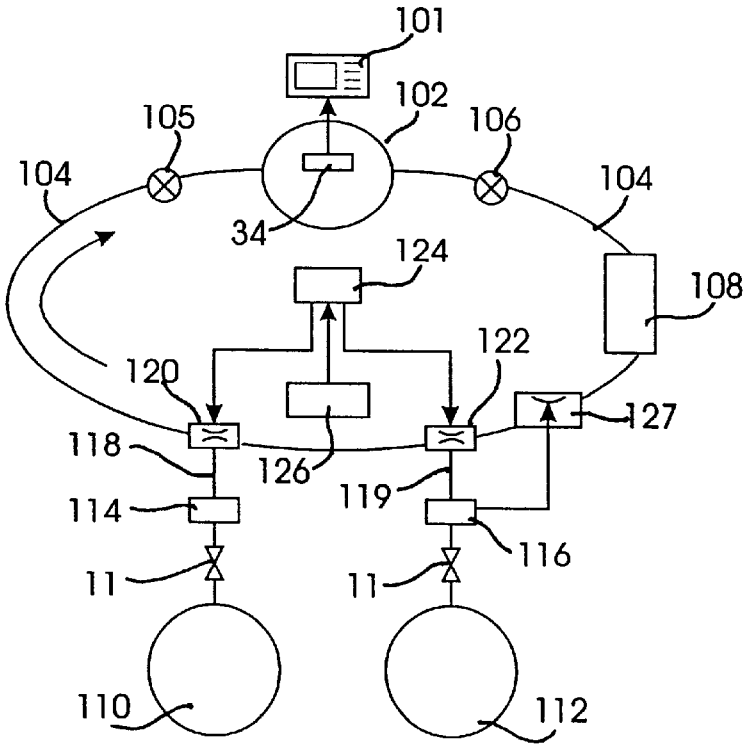
FIG. 4 is a semi-schematic generalized block level diagram of a semi-closed circuit rebreather system in accordance with practice of principles of the invention.

In accordance with practice of the present invention, the rebreather system, which will be described in detail below in connection with FIG. 4, is constructed as a semi-closed circuit rebreather, but unlike existing semi-closed circuit rebreather systems comprising a single breathing gas source, the system according to the invention requires two gas sources. The first gas source comprises a tank containing oxygen or an oxygen enriched gas having an oxygen fraction of from about 0.60 to about 1.0. The second gas source comprises a tank filled with a diluent gas having a lower oxygen content or none. The diluent gas may be air, with an oxygen fraction of 0.21, a suitable inert gas, or a custom diluent gas mix such that the oxygen fraction of the diluent gas may vary anywhere from about 0.0 to about 0.21. As will be described in connection with the rebreather of the invention, below, each gas source or supply tank comprises an independent flow control valve, in order to achieve separate and independent flow rates specified by an algorithm defined in terms of depth (external ambient pressure), minimum and maximum allowable values of oxygen partial pressure ($PO_2$) and minimum and maximum expected values of oxygen consumption.

Minimum and maximum allowable values of $PO_2$ range from between 0.21 and about 1.6 atmospheres, the lower limit having been determined by the need to avoid hypoxia, the upper limited determined by the CNS oxygen toxicity safety limit. In addition, minimum and maximum expected values of oxygen consumption are set, in accordance with the invention, at a range of from between 0.5 to about 3.0 standard liters per minute (SLM). This range of oxygen consumption values has been generally empirically determined to be suitable for use by most divers over most operating conditions.

The minimum and maximum values of oxygen partial pressure and expected values of oxygen consumption given above will be understood to be suitable for purposes of illustration, but are not necessarily hard limits in any sense. Indeed, it is possible to reduce the minimum allowable value of $PO_2$ of from 0.21 atmospheres to about 0.14 atmospheres and still retain sufficient oxygen concentration in the breathing gas mixture to avoid hypoxia. This reduced $PO_2$ value is in accordance with United States Air Force safety standards which allow air crew to breathe air at ambient pressure for altitudes up to 3048 meters, before going on to a source of pure oxygen. Accordingly, it will be understood that while useful for describing and setting the bounds of the present invention, the actual specific values of minimum and maximum $PO_2$ and oxygen consumption may vary without violating the spirit and scope of the present invention. Moreover, as will be brought out in detail in the discussion below, the oxygen consumption values of 0.5 to 3.0 SLM are significantly wider than those practicably obtainable by an experienced diver. These wide ranges of oxygen consumption are posed in the interest of universality of application, but will be seen to be reducible.

Prior to considering a dynamic analysis of the flow loop $PO_2$ from two tanks with different oxygen fractions and independent flow controls, it is necessary to reconsider the oxygen partial pressure in the flow loop as a function of external ambient pressure, i.e., depth. However, in order to define the algorithm, it is necessary to return to first principles.

In rebreather systems, it is well known that ambient pressure increases as the diver descends and the pressure in both the diver's lungs and the rebreather flow loop will increase with depth. While a rebreather is a dynamic system, in that the counterlung expands and contracts as a diver inhales and exhales, the principle underlying the interchange of gas between the diver's lungs and the counterlung is a quasi-steady state flow of gas from the supply tanks into the rebreather system, a flow of excess gas from the rebreather system to the surrounding ambient and extraction of oxygen from the flow loop as it is consumed by a diver. Additionally, it will be recognized that the minimum counterlung oxygen content will occur when a diver's oxygen consumption rate is at a maximum, and the maximum counterlung oxygen content will occur when the diver's oxygen consumption is at a minimum. It remains then to evaluate the quasi-steady state gas flow in the flow loop. The basic governing equations for this underlying process may be given by:

$$P_{AMB}V_{FL}=M_{FL}(R/m_{FL})T_{FL}$$

$$PO_2V_{FL}=M_{o_2}(R/m_{o_2})T_{FL}$$

Where the terms may be defined as follows:

$V_{FL}$ is the volume of the flow loop, including the counterlung in units of liters.

$M_{FL}$ is the total mass of gas within the flow loop in units of grams.

$M_{O_2}$ is the mass of oxygen in the flow loop in units of grams.

$m_{fl}$ is the nondimensional molecular weight of the gas mixture.

$m_{O_2}$ is the nondimensional molecular weight of oxygen (32).

$T_{FL}$ is the mean temperature in degrees Kelvin (K°).

$P_{AMB}$ is the ambient pressure.

As well understood in the art, $P_{AMB}$ is related to depth, D, through the expression $P_{AMB}=1+D/D_{ATM}$, where both D and $D_{ATM}$ are expressed in feet of water and $D_{ATM}$ is the depth at which the ambient pressure will have increased by 1 atmosphere (for sea water $D_{ATM}=33$ feet).

The algorithm requires that the partial pressure of Oxygen ($PO_2$) be bounded by the maximum $PO_2$ allowable for prevention of Central Nervous System (CNS) toxicity and the minimum $PO_2$ required to prevent hypoxia. Typical values for purposes of illustration will be taken to be 1.6 and 0.21 atmospheres, respectively. Prior to imposing these constraints on the system, it will first be necessary to evaluate the conservation of total mass and oxygen in the flow loop. This evaluation is straight-forward and involves differentiating equations 1 and 2 and accounting for the mass flow into and out of the rebreather flow loop.

With regard to mass flow into and out of the flow loop, it should be understood that if mass is being added to the system at a greater rate than it is being consumed, the volume of the flow loop does not change, i.e., $dV_{FL}/dt=0$. In addition, it will be recognized that the quantity $dP_{AMB}/dt$, may be expressed as DR/33, where DR is the well-recognized descent rate and is expressed in feet per minute such that DR/33 has units of atmospheres per minute.

Following differentiation, the terms are rearranged and volumetric flow rates are expressed in STPD units, i.e., Standard Temperature (0 degrees C.), Pressure (1 atmosphere) and Dry. In these terms, and neglecting temperature differences, the resultant equation may be expressed, in simplified form, as:

$$P_{AMB}V_{FL}(dP_{O_2}/dt)=F_{O_2}P_{AMB}V_{O_2}+F_{AIR}P_{AMB}V_{AIR}-P_{AMB}O_2-P_{O_2}[V_{O_2}+V_{AIR}-O_2-V_{FL}(DR/33)]$$

Where tank flow rates, $V_{O2}$ and $V_{AIR}$, and the rate of oxygen consumption, $O_2$, are now expressed in standard liters per minute (SLM).

Removing common terms and grouping flow rate coefficients, the final form of the primary governing equation may be expressed, in simplified form, as:

$$P_{AMB}V_{FL}(dP_{O_2}/dt)=V_{O_2}(F_{O_2}P_{AMB}-P_{O_2})+V_{AIR}(F_{AIR}P_{AMB}-P_{O_2})-0_2(P_{AMB}-P_{O_2})+P_{O2}V_{FL}(DR/33)$$

A key feature of the present invention is the requirement that when the oxygen partial pressure exceeds the maximum, $PO_2$ in the flow loop will be reduced. This is equivalent to requiring that $dPO_2/dt<0$ if and when $PO_2 \geqq PO_2^{max}$ (1.6 atmospheres). In addition, the key feature of the invention requires that oxygen partial pressure increases if partial pressure is less than or equal to the minimum allowed. In a similar manner to the maximum case above, this is equivalent to requiring that $dPO_2/dt>0$ if and when $PO_2 \leqq PO_2^{min}$. Both of these conditions will be satisfied if equality is imposed for the minimum and maximum oxygen consumption rate in accordance with the following equations:

$$V_{O_2}(F_{O_2}P_{AMB}-P_{O_2}^{MAX})+V_{AIR}(F_{AIR}P_{AMB}-P_{O_2}^{MAX})=O_2^{MIN}(P_{AMB}-P_{O_2}^{MAX})-P_{O_2}^{MAX}V_{FL}(DR/33) \quad \text{EQUATION 5}$$

$$V_{O_2}(F_{O_2}P_{AMB}-P_{O_2}^{MIN})+V_{AIR}(F_{AIR}P_{AMB}-P_{O_2}^{MIN})=O_2^{MAX}(P_{AMB}-P_{O_2}^{MIN})-P_{O_2}^{MIN}V_{FL}(DR/33) \quad \text{EQUATION 6}$$

For specified values of $O_2^{MIN}$, $O_2^{MAX}$, $PO_2^{MIN}$, and $PO_2^{MAX}$, these equations are solvable for required tank flow rates as a function solely of depth and its rate of change during a diver's descent or ascent. In accordance with the present invention, the terms of equations 5 and 6 may be rearranged such that the flow rates from the oxygen and diluent tanks are expressed solely in terms of coefficients, in turn depending solely upon the oxygen fraction of the gas in either tank, the maximum and minimum allowable oxygen partial pressure, the maximum and minimum oxygen consumption rate and the ambient pressure, or depth. The governing equation for the algorithm of the present invention is as follows:

$$V_{O_2}=(CE-BF)/(AE-BD) \text{ and } V_{AIR}=(AF-CD)/(AE-BD) \quad \text{EQUATION 7}$$

where $$A=(F_{O_2}P_{AMB}-P_{O_2}^{MAX})$$

$$B=(F_{AIR}P_{AMB}-P_{O_2}^{MAX})$$

$$C=O_2^{MIN}(P_{AMB}-P_{O_2}^{MAX})-P_{O_2}^{MAX}V_{FL}(DR/33)$$

$$D=(F_{O_2}P_{AMB}-P_{O_2}^{MIN})$$

$$E=(F_{AIR}P_{AMB}-P_{O_2}^{MIN})$$

$$F=O_2^{MAX}(P_{AMB}-P_{O_2}^{MIN})-P_{O_2}^{MIN}V_{FL}(DR/33)$$

where $O_2^{MIN}$, $O_2^{MAX}$, $PO_2^{MIN}$ and $PO_2^{MAX}$ are specified design parameters with typical values of 0.5, 3.0, 0.21 and 1.60 respectively, and where the oxygen fraction of the various supply tanks ($F_{O_2}$ and $F_A$) may be chosen by a user and may comprise any value consistent with a suitable solution of the governing equation. Preferably, the oxygen fraction of the two supply tanks will have typical values of from about 0.21 to about 1.0, representing air and pure oxygen respectively.

Semi-Closed Circuit Embodiment

Figure 5:
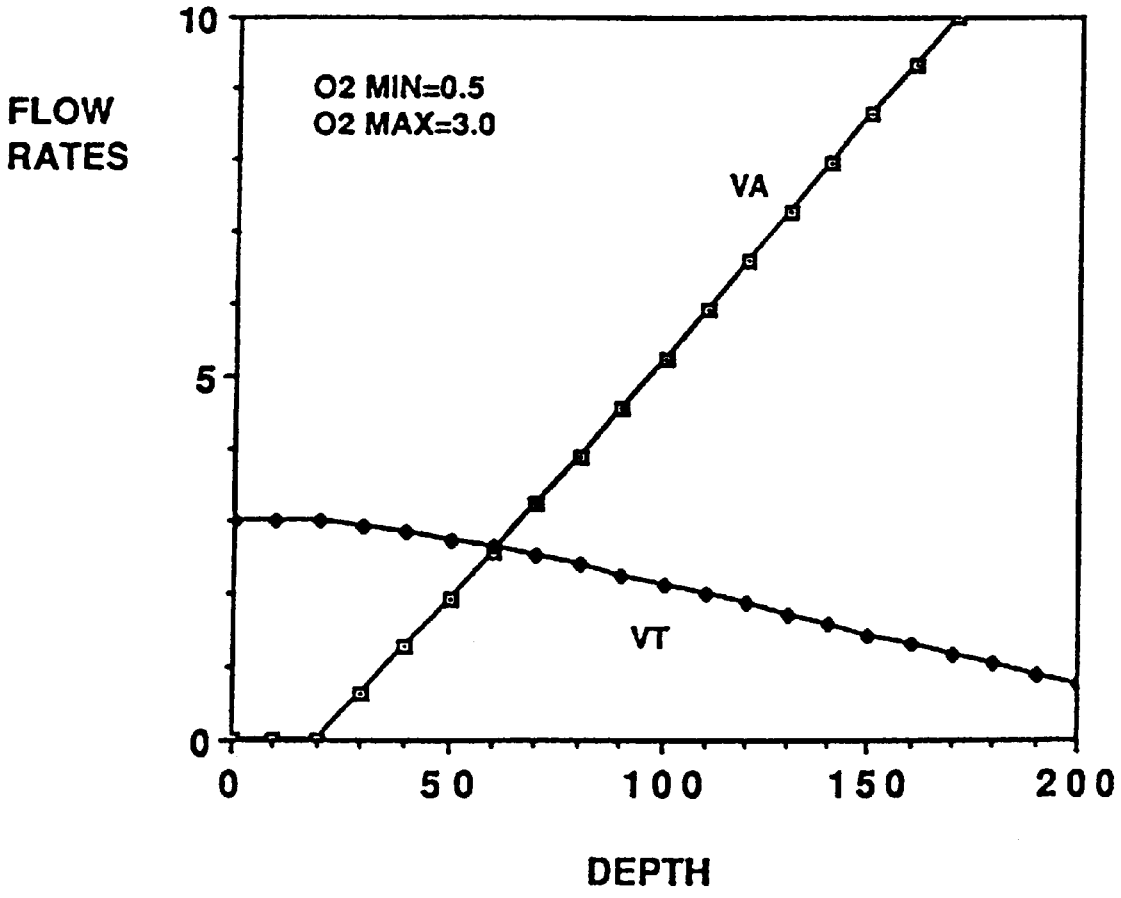
FIG. 5 is a simplified graphical representation of oxygen and diluent flow rates plotted as a function of depth and incorporating wide limits of oxygen consumption, in accordance with practice of principles of the invention.

A particular example of equilibrium (constant depth) flow rates derived from the governing equation 7 is depicted in FIG. 5, and typical values for the equilibrium flow rates and the resultant $PO_2$ for various rates of oxygen consumption are given in the following Table 1.

TABLE 1

| DEPTH | VA | VT | $O_2$ = 0.5 | $O_2$ = 1.25 | $O_2$ = 3.0 |
|---|---|---|---|---|---|
| 20 | 0.01 | 3.00 | 1.60 | 1.60 | 0.21 |
| 40 | 1.26 | 2.84 | 1.60 | 1.44 | 0.21 |
| 60 | 2.57 | 2.62 | 1.60 | 1.37 | 0.21 |
| 80 | 3.90 | 2.38 | 1.60 | 1.33 | 0.21 |
| 100 | 5.24 | 2.13 | 1.60 | 1.30 | 0.21 |
| 120 | 6.60 | 1.86 | 1.60 | 1.28 | 0.21 |
| 140 | 7.96 | 1.59 | 1.60 | 1.27 | 0.21 |
| 160 | 9.33 | 1.32 | 1.60 | 1.26 | 0.21 |
| 180 | 10.69 | 1.04 | 1.60 | 1.25 | 0.21 |
| 200 | 12.06 | 0.76 | 1.60 | 1.25 | 0.21 |
| 220 | 13.43 | 0.48 | 1.60 | 1.24 | 0.21 |
| 240 | 14.81 | 0.20 | 1.60 | 1.24 | 0.21 |
| 260 | 16.18 | 0.00 | 1.64 | 1.28 | 0.27 |
| 280 | 17.55 | 0.00 | 1.77 | 1.42 | 0.45 |
| 300 | 18.93 | 0.00 | 1.90 | 1.56 | 0.62 |
| 320 | 20.30 | 0.00 | 2.03 | 1.69 | 0.78 |

The values in both Table 1 and the graph of FIG. 5 have been calculated using a first tank filled with pure oxygen and a second tank filled with air. Minimum and maximum values of $PO_2$ were chosen to be 0.21 and 1.6 respectively, while minimum and maximum values of the oxygen consumption rate were chosen to be 0.5 and 3.0, respectively. From FIG. 5, it can be seen that the flow rates for the oxygen tank will be a maximum of about 3 liters per minute at shallow depths (about 20 feet) and then diminish to a value of less than 1 liter per minute as the depth approaches 200 feet. The accompanying air tank will experience no flow for depths shallower than about 20 feet and exhibit an approximately linearly increasing flow rate to a value exceeding 10 liters per minute at a depth of about 170 feet.

A particular behavioral characteristic of the algorithm of the present invention occurs at depths in excess of about 250 feet, as can be seen in Table 1. For the minimum oxygen consumption rate of 0.5 liters per minute, the maximum $PO_2$ requirement (1.6 atm) is exceeded beyond a depth of about 255 feet. The reason for this is clearly evident when it is recognized that the diluent tank (in this case air) contains a fixed minimum fraction of oxygen (in this case 0.21) whose partial pressure increases with depth in conventional fashion. At the crossover point of 255 feet, the solution to the governing equation would call for a negative flow rate from the $O_2$ supply canister, and since this is physically impossible, $O_2$ reduces to 0 which leaves a single parameter, i.e., the $V_{AIR}$. Of particular note is the fact that for more realistic rates of minimum oxygen consumption, i.e., rates in excess of 1.25 liters per minute, $PO_2$ rates in excess of the $PO_2$ maximum occur only at depths greater than 300 feet as depicted in Table 1.

TABLE 2

| DEPTH | VA | VT | $O_2$ = 1 | $O_2$ = 1.5 | $O_2$ = 2.0 |
|---|---|---|---|---|---|
| 20 | 0.00 | 2.00 | 1.60 | 1.59 | 0.21 |
| 40 | 0.50 | 1.94 | 1.60 | 1.27 | 0.21 |
| 60 | 1.03 | 1.85 | 1.60 | 1.16 | 0.21 |
| 80 | 1.56 | 1.75 | 1.60 | 1.10 | 0.21 |
| 100 | 2.10 | 1.65 | 1.60 | 1.06 | 0.21 |
| 120 | 2.64 | 1.54 | 1.60 | 1.03 | 0.21 |
| 140 | 3.18 | 1.44 | 1.60 | 1.02 | 0.21 |
| 160 | 3.73 | 1.33 | 1.60 | 1.00 | 0.21 |
| 180 | 4.28 | 1.22 | 1.60 | 0.99 | 0.21 |
| 200 | 4.82 | 1.10 | 1.60 | 0.98 | 0.21 |
| 220 | 5.37 | 0.99 | 1.60 | 0.98 | 0.21 |

TABLE 2-continued

| DEPTH | VA | VT | $O_2$ = 1 | $O_2$ = 1.5 | $O_2$ = 2.0 |
|---|---|---|---|---|---|
| 240 | 5.92 | 0.88 | 1.60 | 0.97 | 0.21 |
| 260 | 6.47 | 0.76 | 1.60 | 0.97 | 0.21 |
| 280 | 7.02 | 0.65 | 1.60 | 0.96 | 0.21 |
| 300 | 7.57 | 0.54 | 1.60 | 0.96 | 0.21 |
| 320 | 8.12 | 0.42 | 1.60 | 0.95 | 0.21 |

Figure 6:
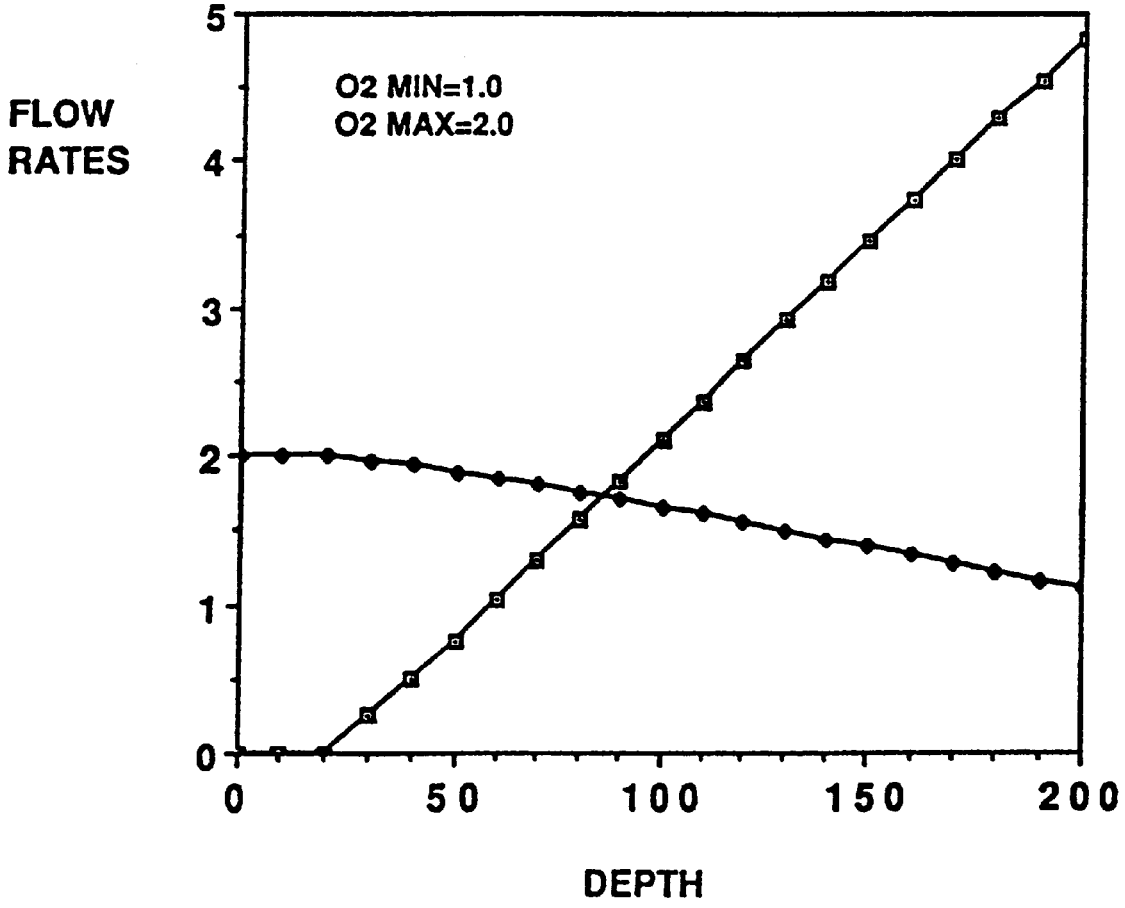
FIG. 6 is a simplified graphical representation of oxygen and diluent flow rates plotted as a function of depth and incorporating narrow limits of oxygen consumption, in accordance with practice of principles of the invention.

Moreover, as can be seen with reference to Table 2, when the range of oxygen consumption is bound by a more restrictive minimum of 1.0 liters per minute to a maximum of 2.0 liters per minute, flow rates from both the $O_2$ and diluent tanks are substantially reduced, particularly for the air or diluent tank. Indeed, it can be seen from Table 2 that for a more constrained range of oxygen consumption, the $PO_2$ max requirement of the present invention is satisfied for all depths down to and exceeding 330 feet. Thus, a particular diver may monitor and record their rates of oxygen consumption and use their local minima and maxima as upper and lower boundaries for the $O_2$ consumption term in the governing equation of the present invention. For a particular diver able to operate within more restrictive oxygen consumption limits, dive time is greatly increased for a particular tank size because of the significantly reduced flow rates from the oxygen and diluent tanks. This resultant performance increase, is depicted in FIG. 6.

Although the preceding analysis was performed in terms of a quasi-steady state (constant depth) regime, the algorithm of the present invention is more than suitable for adaptation for evaluating transient behavior, such as during ascent and descent. Since the initial flow from the air or diluent tank is nominally zero at shallow depths (less than about 20 feet) the initial oxygen content of the flow loop (the counterlung) will be equal to that of the oxygen rich tank, i.e., 1.0 for $F_I$=1.0. During descent, certain critical depths are reached at which the maximum allowable $PO_2$ is exceeded because of transient effects. One particular solution, in accordance with the invention, is to add diluent gas from the diluent or air tank to counter act the tendency of the counterlung to collapse because of the increased ambient pressure as a diver descends. Adding gas to the counterlung is achieved mechanically by providing a demand regulator within the counterlung that introduces gas from the diluent or air tank by controlling the diluent or air flow valve in a manner directly proportional to the descent rate. Lever-operated down stream demand regulators are particularly suitable for this application since the material of the counterlung provides the same function as the breathing diagram in a conventional second stage SCUBA-type demand regulator well known in the art. The collapsing material of the counterlung activates a lever which in turn, displaces a poppet from a low-pressure air hose coupled to a step-down pressure regulator connected to the air or diluent tank. As the poppet displaces from the flow path, air or diluent gas is introduced into the counterlung which expands in response, thus relieving the pressure on the lever and allowing the poppet to close. If sufficient gas is added to maintain a constant counterlung volume, the additional gas and its oxygen content must be evaluated. The equation that must be integrated is expressed as:

$$V_{FL}(dP_{O_2}/dt)=(F_{O_2}V_{O_2}+F_{AIR}V_{AIR}-O_2)-(P_{O_2}/P_{AMB})(V_{O_2}+V_{AIR}-O_2-V_{FL}(DR/33)) \quad \text{EQUATION 14}$$

since the resulting flow rates are not simple functions of depth, a numerical solution is required for equation 14. Numerical solution yields critical depths, beyond which the $PO_2^{MAX}$ requirement is exceeded, that are shallower than the 250 foot limit defined for the quasi-steady state (constant depth) solutions.

Figure 7:
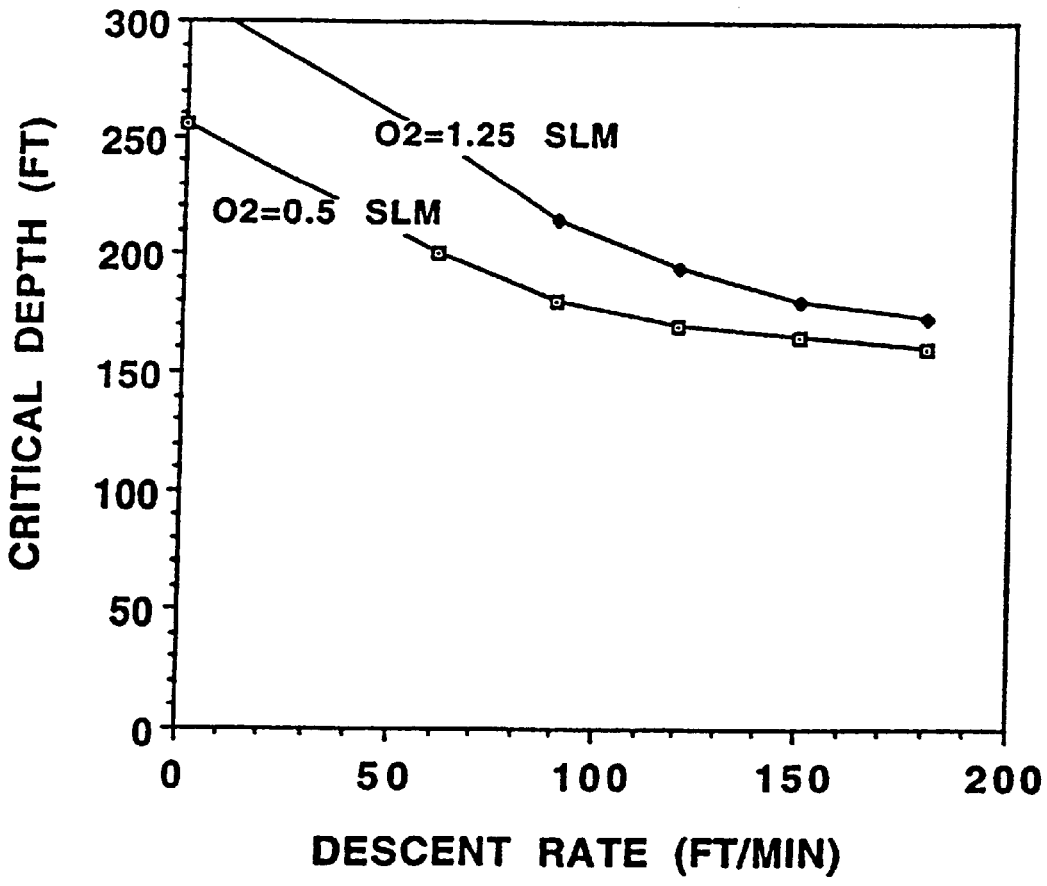
FIG. 7 is an exemplary, simplified graphical representation of critical depth at which oxygen partial pressure exceeds 1.6 plotted as a function of the descent rate.

The results of an analysis of critical depth as a function of descent rate for two values of oxygen consumption, are given in FIG. 7. As expected, the critical depth at which $PO_2^{MAX}$ exceeds 1.60, decreases with increasing descent rate. However, even for the maximum descent rate in FIG. 7 of greater than 180 feet per minute (practicably unobtainable) the critical depth remains greater than 160 feet. It should be noted that the rate of oxygen consumption for this calculated descent rate and critical depth is the minimum rate of 0.5 SLM.

In accordance with the present invention, maximum descent rates can be calculated as a function of depth and displayed to the diver prior to the dive as a profile. Technical divers who wish to dive deeper than 160 feet must simply construct an appropriate descent profile and monitor and control their descent rates to remain within their desired profile.

A particular embodiment of a semi-closed circuit rebreather system suitable for practice of principles of the invention is depicted in FIG. 4 which is a semi-schematic generalized block level diagram of the overall mechanical system of a semi-closed circuit rebreather. Although similar in several respects to the semi-closed circuit rebreather system of the prior art, the rebreather system of FIG. 4 is particularly configured to provide breathing gas to a diver at an adaptively adjustable rate which depends solely on depth, so as to maintain a specified range of partial pressures of oxygen.

In FIG. 4, the overall mechanical system of the design is depicted and suitably comprises a flow loop, generally indicated at 100, in turn comprising a flexible, volumetrically defined counterlung 102 from which a diver inhales and to which a diver exhales a breathing gas mixture through a suitable mouthpiece. The counterlung 102 is coupled into the flow loop 100 by means of suitable low pressure hoses 104 which define the gas flow path of the flow loop. Gas flow direction through the low pressure hoses 104 are controlled by first and second 1-way check valves 105 and 106 which are disposed along the low pressure hoses 104 and positioned so as to define the flow of breathing gas into and out of the counterlung 102. Maintaining the correct breathing gas flow direction is important, since a diver's exhaled breath contains quantities of carbon dioxide which must be removed from the exhaled gas volume before the remaining residual oxygen-containing gas is reintroduced to the gas flow and, thus, the counterlung 102. Carbon dioxide ($CO_2$) is removed from the exhaled gas volume by a $CO_2$ scrubber canister 108 which is disposed in gas flow in a direction defined as down-stream from the counterlung 102. Operation of the 1-way check valves 105 and 106 ensures that the exhaled gas volume leaves the counterlung through the appropriate low pressure hose which is coupled to the $CO_2$ scrubber canister 108, rather than allowing cross flow between $CO_2$ containing exhaled gas and an incoming volume of breathing gas from the gas source.

The construction and operation of the $CO_2$ scrubber canister 108 is well understood by those having skill in the art and may comprise any one of a number of commonly used $CO_2$ removal systems. Preferably, the $CO_2$ scrubber canister 108 comprises a soda lime cartridge having about 3 to 5 hours of $CO_2$ scrubbing capability. Breathing gas is supplied to the flow loop 100 by a breathing gas source suitably comprising first and second cylinders, 110 and 112, respectively, capable of receiving and holding a volume of a compressed breathing gas. The first cylinder 110 comprises an oxygen or oxygen rich gas, preferably oxygen ($O_2$) in its pure form, while the second tank 112 is filled with a volume of a compressed diluent gas, such as air, which as will be described in greater detail below, may be mixed with oxygen from the first tank 110 to thereby vary the partial pressure of oxygen provided to the flow loop of the rebreather system. Preferably , the diluent tank 112 contains a volume of compressed air which, as is generally understood by those having skill in the art, contains a specific fraction of oxygen (0.21) in the gaseous mix. Alternatively, the diluent gas contained within the diluent tank 112 may be any one of the number of inert gasses which have been conventionally determined as suitable for deep diving operations, or a custom mixture of such an inert gas with a specific fraction of oxygen.

The oxygen and diluent tanks, 110 and 112 respectively, are coupled to the flow loop 100 through on-off values 11 and respective high pressure regulators 114 and 116. The pressure regulators 114 and 116 regulate and reduce the gas flows from the oxygen and diluent tanks to a lower, operating, pressure suitable for the low pressure hoses 104 comprising the rebreather flow loop 100. Various pressure regulator designs are suitable for use with the rebreather system of the present invention, and might indeed be implemented as moving orifice-type pressure regulators, balanced flow-through piston-type, or the like. A typical implementation of the pressure regulators 114 and 116 reduces the gas pressure of compressed oxygen or compressed diluent gas within their respective storage tanks 110 and 112, from their nominal, compressed, values to a lower pressure of about ten atmospheres (10 atm). While described as reducing gas pressures from current tank pressure to about ten atm, it will be understood by those with skill in the art that the pressure regulators 114 and 116 may be set to deliver low pressure gas at pressures quite different from 10 atm.

Low pressure regulated gas, whether oxygen or diluent, is coupled to the flow loop 100 by means of low pressure hoses 118 and 119, each of which are connected to introduce oxygen or diluent gas from their source tanks to individual mass flow control valves 120 and 122. Oxygen is introduced into the flow loop 100 through mass flow control valve 120, while the diluent gas is introduced to the flow loop through mass flow control valve 122. During normal operation of the rebreather, mass flow control valves 120 and 122 determine the amount of oxygen and diluent, respectively, which is introduced to the system in order to maintain the partial pressure of the breathing gas within the specified range.

Prior to discussing the construction of mass flow control valves 120 and 122, it is necessary to return momentarily to the graph of flow rate as a function of depth as depicted in FIG. 5. Inspection of the flow rate values shown in FIG. 5, and analysis of the data contained in Table 1, shows that for the oxygen consumption extremes chosen, both oxygen and diluent flow rates are approximately linear with respect to depth. Indeed, analysis of the data of Table 1 indicates that diluent, or air, flow rates will increase with depth at a rate of approximately 0.07 SLM per foot. Likewise, oxygen flow rates will decrease with depth at a rate of approximately −0.014 SLM per foot. Similar calculations can be performed on the data of Table 2 to give similar results, varying only in the numerical value obtained for the rate of flow rate change per foot of depth.

Thus, with oxygen and diluent (or air) flow rates exhibiting linear dependence on depth, it can be understood that mass flow control valves 120 and 122, in one embodiment of the invention, are implemented as a simple, mechanical flow control valve, preferably a first stage regulator that produces an intermediate pressure that is depth dependent, coupled to a sonic orifice, which produces flow rates dependent solely on depth in accordance with a rate of change derived in accordance with the invention. Such a mechanical construction is well within the contemplation of those having skill in the art and indeed, can be easily implemented by making suitable modifications to any one of a number of conventional first stage regulators implemented in prior art closed or semi-closed rebreather systems. While the mechanical embodiment of the invention has the advantage of simplicity, it is unable to account for the descent rate terms given in Equation 7. This further increases the probability that the partial pressure of oxygen will exceed the specified maximum value during descent. There are number of solutions to this problem such as adding a rigid volume between the oxygen rich gas source and the counterlung (a particular embodiment of which is disclosed in U.S. Pat. No. 4,454,878 to Morrison) or the addition of an electronically controlled solenoid valve coupled to a pressure transducer, either of which stops or reduces the flow of oxygen rich gas when the descent rate exceeds a specified value. For an embodiment that includes an oxygen sensor, the electronically controlled valve functions to stop the flow of the oxygen rich gas before the partial pressure of oxygen exceeds the maximum specified value.

In a further embodiment of a semi-closed circuit rebreather system in accordance with the invention, mass flow control valves 120 and 122 suitably comprise electronically controlled mass flow valves operable in response to a control signal received from a suitable signal processing circuit, thereby automating the control of gas flow from the oxygen and diluent tanks 110 and 112 respectively. The signal processing circuit 124 is implemented, in accordance with the invention, as a microprocessor, microcontroller, or a digital signal processor circuit, capable of being programed by a user with the various user defined parameters (such as oxygen consumption, the oxygen content of the oxygen and diluent gas cylinders, and the like), and further capable of carrying out the calculations defined in Equation 7 so as to define the flow rates from the oxygen and the diluent cylinders as a function of depth.

In this regard, the signal processing circuit 124 includes a sensor input port for receiving signals from a pressure transducer 126 which converts, in conventional fashion, a measurement of ambient pressure to a depth below the surface. Both the signal processing circuit 124 and the pressure transducer 126 are implemented from conventional, commercially available components; the signal processing circuit 124 being adapted from any available firmware programmable microcontroller circuit having an input and an output bus and including an arithmetic computational ability. Various such circuits are manufactured by Motorola, Intel Corporation; and Advanced Micro Devices, all of which are suitable for incorporation into the present invention. The depth transducer 126 is likewise implemented from a conventional, commercially available device and is offered in various forms as part of a dive computer suite, by virtually every recreational dive equipment manufacturer.

In operation, pressure transducer 126 senses the depth of a diver and provides a suitable control signal to signal processing circuit 124. In response, the signal processing circuit 124 calculates oxygen and diluent tank flow rates in accordance with Equation 7, using the value of depth determined by the pressure transducer 126, the minimum and maximum oxygen partial pressure values, the minimum oxygen consumption values and oxygen fraction values for the system which have been previously input by a user. Alternatively, an oxygen sensor 34 is disposed in the system's counterlung 102. The signal processing circuit 124 is coupled to the oxygen sensor 34 and performs oxygen consumption rate calculations in operative response to signals received from the oxygen sensor. The signal processing circuit calculates and records a diver's oxygen consumption rate, as measured by the oxygen sensor 34, to thereby define a maximum and minimum oxygen consumption rate for a diver under actual conditions. The signal processing circuit 124 adaptively adjusts the oxygen and diluent tank flow rates in accordance with the calculated oxygen consumption parametric range and as a function of depth. As described above, oxygen consumption rate and a diver's local minima and maxima may be monitored on a display console 101.

In accordance with the invention, signal processing circuit 124 issues control signals to mass flow control valves 120 and 122, which adjust the oxygen and diluent flow rates, respectively, in response thereto.

In a preferred embodiment that includes both mechanical and electronically controlled mass flow valves, the electronically controlled valves are designed and constructed to fail-open. This condition will ensure that in the event of system failure, oxygen is always available to the diver in sufficient quantities to prevent hypoxia, while the diver makes his way to the surface in an emergency ascent.

Figure 1:
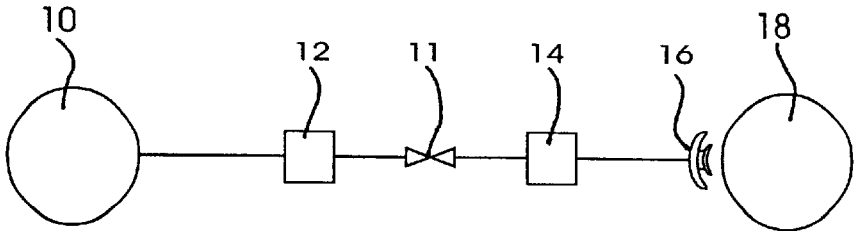
FIG. 1 (Prior Art)
FIG. 1 is a semi-schematic generalized block level diagram of an open circuit breathing apparatus in accordance with the prior art.
Figure 2:
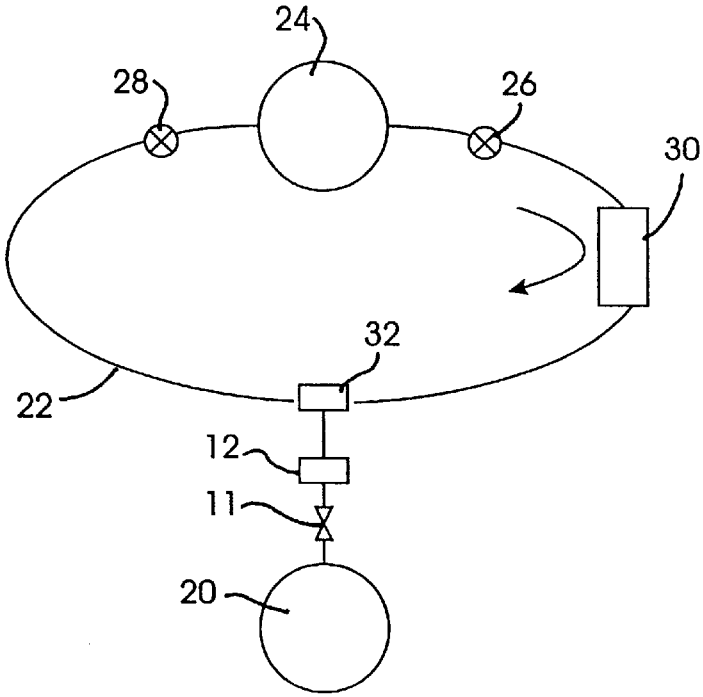
FIG. 2 (Prior Art)
FIG. 2 is a semi-schematic generalized block level diagram of a semi-closed circuit rebreather system, in accordance with the prior art.
Figure 3:
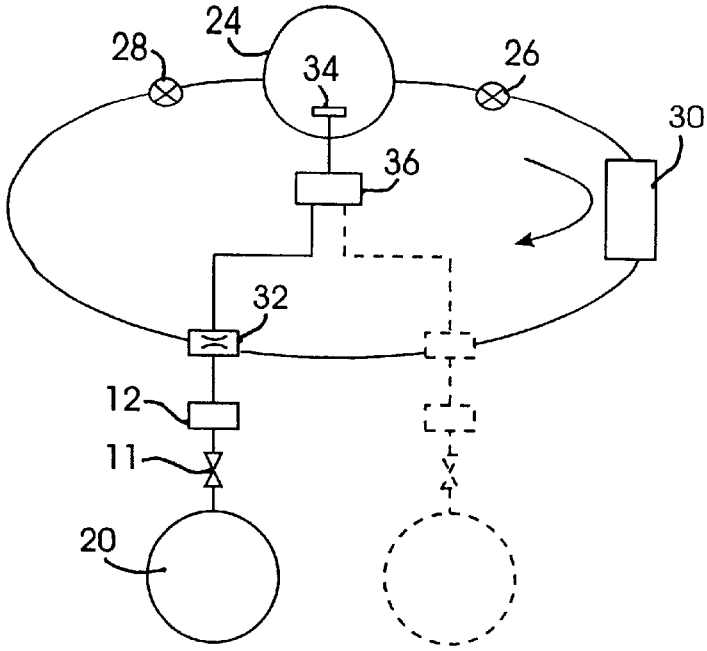
FIG. 3 (Prior Art)
FIG. 3 is a semi-schematic generalized block level diagram of a closed circuit rebreather system including an oxygen rich breathing gas supply tank, diluent gas supply tank, and an oxygen sensor, in accordance with the prior art.

In a further embodiment of the invention, it will be understood that the high pressure regulator 116 connected to the diluent source 112, may include an additional low-pressure port to which a conventional SCUBA-type second stage regulator 127 may be attached. When the diluent source 112 is configured as a compressed air cylinder, the compressed air cylinder in combination with a second stage regulator functions as a bail-out bottle under certain emergency conditions. In the limit, the diluent cylinder 112, high pressure regulator 116 and an optional second stage regulator 127 comprises a simple SCUBA-type apparatus such as depicted in FIG. 1.

Additionally, it will be understood by those having skill in the art that using air as a diluent gas source has certain disadvantages as the diving depth reaches and exceeds 150 feet. In particular, the major component of air is nitrogen, which is recognized as the contributor to certain undesirable physiological effects. Nitrogen narcosis is known to effect divers when the diving depth exceeds 150 feet and can lead to serious consequences, including death, due to its induced state of euphoria Accordingly, the invention may be provided with a second diluent gas source filled with for example, a heliox mixture (20% oxygen and 79% helium) which is switched into the flow loop in place of air or some other oxygen/nitrogen mixture, at depths greater than about 150 feet. It will thus be seen that the rebreather system, in accordance with the invention, is adaptable to mixed-gas diving, by merely providing conventionally derived gas sources and performing the necessary calculations in accordance with the algorithm.

Closed Circuit Embodiment

In the semi-closed circuit embodiment described above, a major feature of the invention is the dynamic and adaptable adjustment of oxygen and diluent flow rates as a function of depth alone. An accurate oxygen sensor provided in accordance with the present invention improves the performance of a rebreather system significantly. As was depicted in FIGS. 5 and 6 and in accordance with the values listed in Tables 1 and 2, when the range of oxygen consumption is bounded by a more restrictive set of minima and maxima, flow rates from the oxygen and diluent tanks are dramatically reduced, particularly for the diluent tank. Indeed, conventional closed circuit rebreather systems monitor the partial pressure of oxygen within the counterlung and provide additional oxygen to the system solely at a rate necessary to maintain a pre-set $PO_2$ value, i.e., 1.6 atmospheres. Conventional air or diluent tanks are provided to add gas during descent when the counterlung is collapsed by the increase in hydrostatic pressure. Conventional closed circuit rebreather systems are designed to add oxygen to the system at a rate equal to the rate oxygen is being consumed by the diver. However, conventional systems have no way of obtaining a direct measurement of the oxygen consumption rate and use an oxygen sensor primarily to monitor the $PO_2$ within the counterlung. Gas flow control is adjusted to maintain $PO_2$ at a constant preset value, typically the maximum allowed by CNS toxicity limits.

In accordance with principles of the present invention, a closed circuit rebreather system when used in combination with an accurate and reliable oxygen sensor allows the calculation of a $PO_2$ value, based on practical recreational factors such as decompression considerations and pulmonary toxicity limits, which value can be calculated to give maximum dive time and minimum decompression time.

Figure 8:
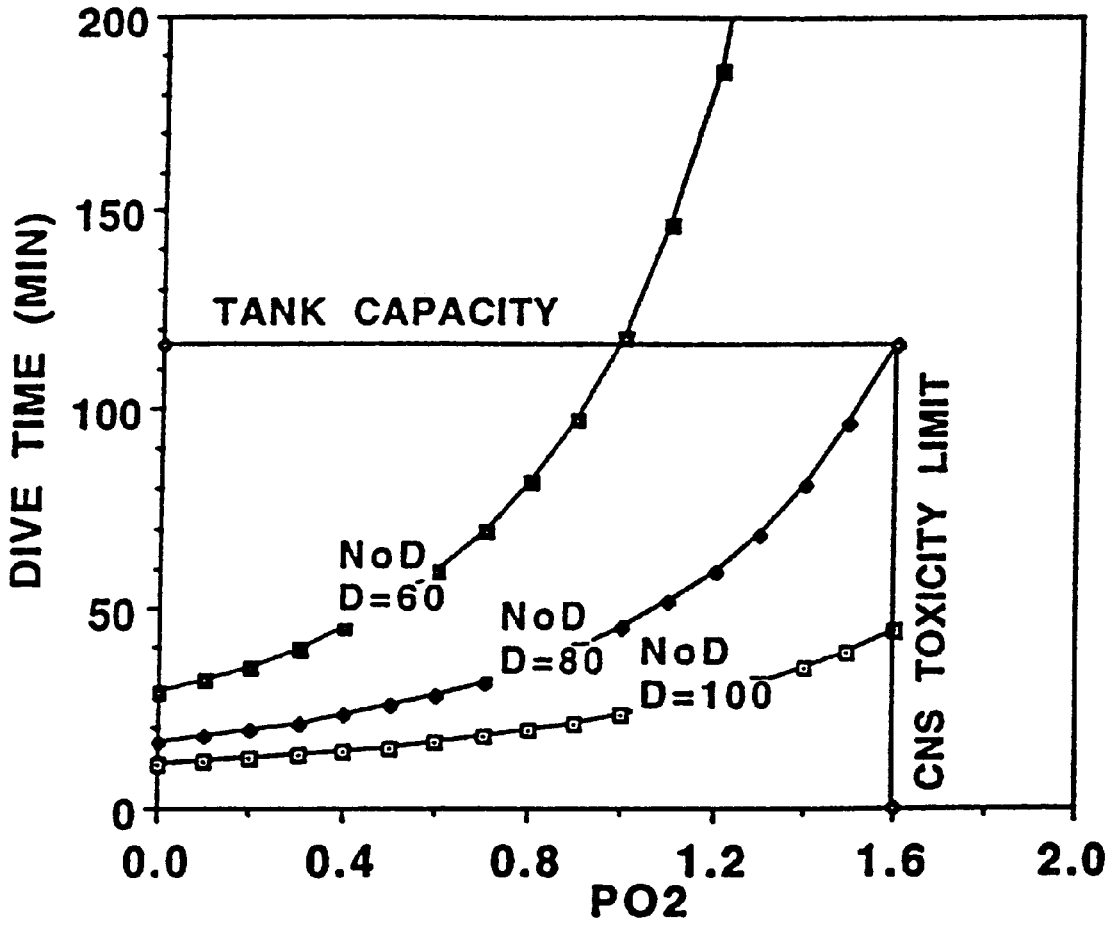
FIG. 8 is an exemplary simplified graphical representation of dive time in minutes plotted as a function of oxygen partial pressure, with No D times plotted at various depths for various values of oxygen partial pressure.

In the absence of other considerations, dive time is ultimately controlled by the capacity of the breathing gas tank, i.e., the amount of breathing gas that is available, while $PO_2$ is controlled by the CNS toxicity limit. An illustration of the dependence of performance on oxygen partial pressure of a closed circuit rebreather is depicted in FIG. 8. FIG. 8 is a graphical representation of dive time in minutes plotted as a function of $PO_2$, with no-decompression (No D) times plotted at various depths for various values of $PO_2$. As can be seen in FIG. 8, for the shallowest depth of 60 feet and for a $PO_2$ of 1.6, the no-decompression time limit greatly exceeds by the time limit imposed by the capacity of the tank, and the dive will be terminated when tank capacity is exhausted. It is evident from FIG. 8 that the $PO_2$ for this particular dive could be reduced to a value of about 1.0 without impacting the dive time, i.e., the dive time would still be tank capacity limited.

For intermediate depths of about 80 feet, the no-decompression time limit corresponds to the tank capacity limit at a $PO_2$ of 1.6. Setting the $PO_2$ to a lower value would, in this case, cause the diver to either ascend to a shallower depth when the no-decompression time at 80 feet expires (a common practice among recreational divers known as multilevel diving) or remaining at 80 feet and enter a decompression regime. In this particular example, the choice of $PO_2$=1.6 is optimal, and to reduce it would have degraded a diver's options. However, as can be seen from FIG. 8, for depths in excess of 80 feet, i.e., for a depth of 100 feet, the maximum no-decompression time (for a $PO_2$=1.6) is about 40 minutes with the CNS toxicity limit on $PO_2$ restricting the diver's options with respect to additional No D time. Thus, it can be seen that for a depth of about 100 feet and a No D time of about 40 minutes, considerable tank capacity remains. In this particular case, a diver has the choice of either remaining at 100 feet and accepting a decompression obligation or ascending to a shallower depth in order to remain within a No D regime. If a diver chooses to accept the decompression obligation, the diver may stay at 100 feet until the remaining tank capacity is used, with the constraint that sufficient capacity must remain to pass through the decompression regime. For the No D multilevel dive, $PO_2$ could have been reduced to a lower value such that the remaining tank capacity and No D times were equal without diminishing dive time, but in the absence of pulmonary oxygen toxicity considerations, this is not necessary.

However, the addition of constraints associated with pulmonary oxygen toxicity results in situations in which a reduced value of $PO_2$ improves the performance of the rebreather in several important aspects.

Figure 9:
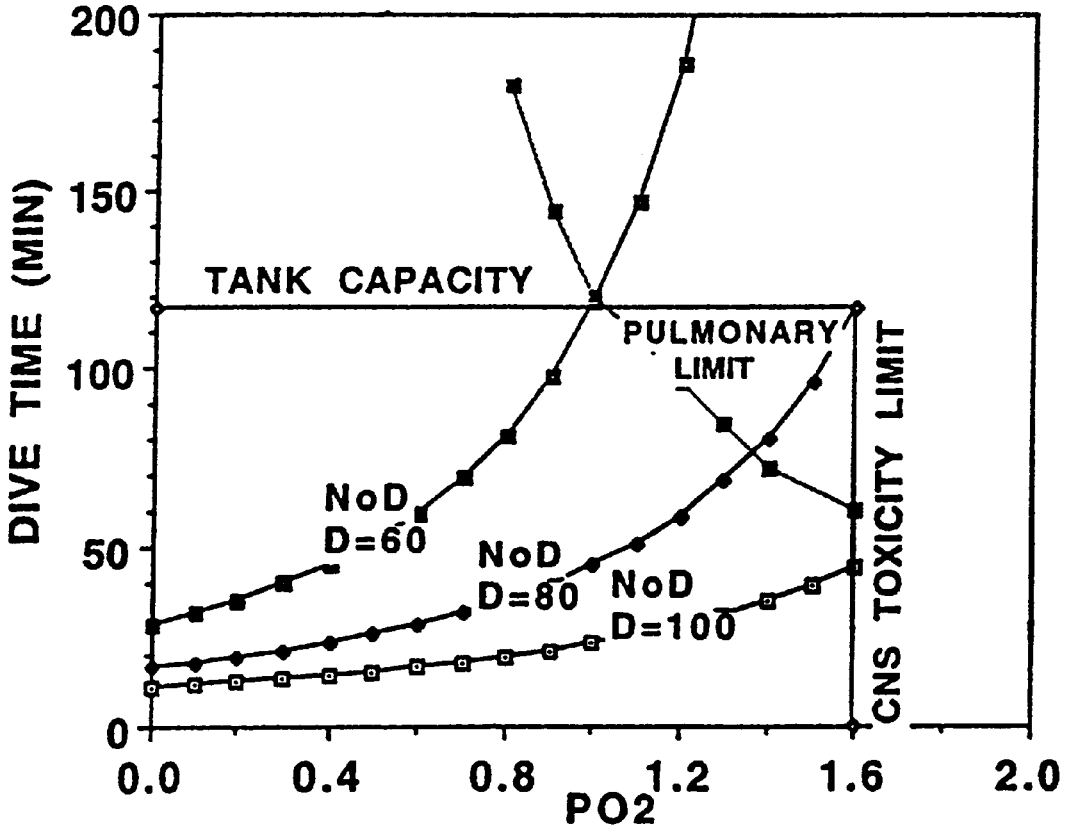
FIG. 9 is an exemplary simplified graphical representation of pulmonary toxicity limits superposed on the graphical representation of dive time and oxygen partial pressure of FIG. 8.

Turning now to FIG. 9, pulmonary toxicity limits, as defined by the National Oceanographic and Atmospheric Administration (NOAA) have been superposed on the graphical representation of dive time and $PO_2$ of FIG. 8. As can be seen in FIG. 9, pulmonary oxygen toxicity considerations have the effect of decreasing allowable dive time as $PO_2$ increases. Thus, for depth shallower than approximately 60 feet there are multiple choices of the value of $PO_2$. One could choose a value of $PO_2$ where the pulmonary toxicity limit equals tank capacity ($PO_2$=1.0 in the illustration of FIG. 9), or choose a lower value of $PO_2$ where the no-decompression time equals tank capacity. Neither choice would effect dive time in this circumstance, but since there are well-defined daily pulmonary constraints, the small value of $PO_2$ is preferred. The dive time of any one particular dive is not diminished, but the pulmonary toxicity limits imposed by subsequent repetitive dives will be increased.

Thus, it can be seen that where the pulmonary toxicity limit equals or exceeds the dive time as controlled by tank capacity, the optimum solution for $PO_2$ is that which equates no-decompression time to tank capacity time.

For depths greater than 60 feet, i.e., depths at which pulmonary toxicity limits restrict dive times to values less than tank capacity, an additional degree of freedom is available over that imposed by conventional rebreather systems. Following the example of FIG. 6, for a depth of approximately 100 feet, as was the case in the absence of pulmonary toxicity limits, a diver has a choice of either staying at that depth his No D limit and accepting a decompression obligation, or a diver may ascend to a shallower depth and stay within the No D limits. If a diver chooses the second option, i.e., a multi level dive, both capacity and no-decompression times will be reduced somewhat. However, an optimum solution for $PO_2$ will be either when the no-decompression time is equal to tank capacity time or when the pulmonary toxicity limit time is equal to tank capacity time and one can anticipate either eventuality by choosing the minimum of these values.

If a diver chooses to accept the decompression obligation, the diver may remain at 100 feet, but it is important to note that if the pulmonary toxicity limit is reached, the value of $PO_2$ must be reduced to approximately 0.5 atm for which the pulmonary toxicity time limit is unlimited. However, $PO_2$=0.5 can result in an unnecessarily long decompression. In order to maximize bottom time while minimizing decompression time, a value of $PO_2$ is chosen such that the tank capacity time at depth when diminished by the capacity required for decompression, is equal to the pulmonary toxicity limit time at depth, that has been diminished by the pulmonary time required for maximum $PO_2$ during decompression.

Figure 10:
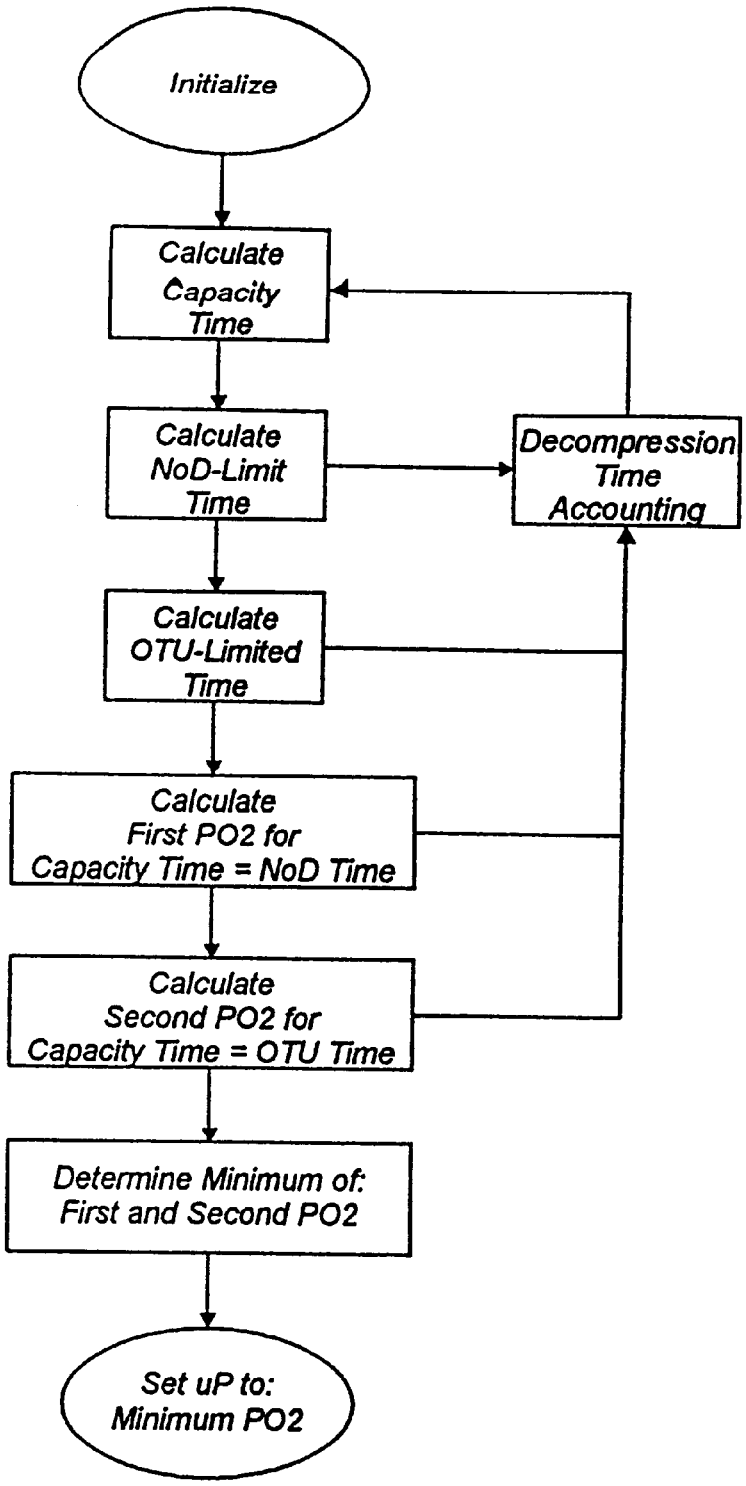
FIG. 10 is an exemplary simplified flow chart which depicts a method for determining a dive profile such that bottom time, No D time and oxygen toxicity time limits may be optimized.

The above-described rules may be summarized with reference to the exemplary simplified flow chart of FIG. 10 which illustrates the procedure. In particular, in accordance with the flow diagram of FIG. 10, the procedure begins by calculating the tank capacity limited dive time, including any time limitations imposed by a decompression obligation. A second calculation is performed and determines the dive time that is limited by the no-decompression time available for the desired diving depth. A further calculation is performed and determines the dive time that is limited by both single dive and daily allowable oxygen toxicity limits, with the minimum values used to govern the dive. Care must be taken to account for oxygen toxicity limitations imposed during any decompression obligation.

From the capacity limited dive time and the no-decompression limited dive time values, a value of $PO_2$ is determined from, for example, the graph of FIG. 8 or FIG. 9, for which the tank capacity limitation is equal to the no-decompression limitation. Further, a value of $PO_2$ is determined for which the capacity limited dive time is equal to the pulmonary toxicity limited dive time as determined above. For either value of $PO_2$ determined above, the minimum of these values is chosen as the $PO_2$ set point for a closed circuit rebreather system constructed in accordance with practice of the present invention. The value of $PO_2$ is set equal to the minimum of either value determined above, with the additional constraint that it be greater than 0.5 and less than the maximum allowable, i.e., 1.6 atm.

It is important to note that both single and daily allowable oxygen toxicity limits be monitored, with the minimum values used to govern the parameters of a dive.

This method of calculating a particular value of $PO_2$ may be better understood when considered in the context of a specific example. As a practical matter, oxygen toxicity dive time limits are set out as a function of the partial pressure of oxygen in the following table, Table 3.

TABLE 3

| $P_{O2}$ | Single Dive | Daily Limit |
|---|---|---|
| 0.5 | no limit | no limit |
| 0.6 | 720 min | 720 min |
| 0.7 | 570 | 570 |
| 0.8 | 450 | 450 |
| 0.9 | 360 | 360 |
| 1.0 | 300 | 300 |
| 1.1 | 240 | 270 |
| 1.2 | 210 | 240 |
| 1.3 | 180 | 210 |
| 1.4 | 150 | 180 |
| 1.5 | 120 | 180 |
| 1.6 | 45 | 150 |

Allowable dive times at a particular $PO_2$ are converted into a rate of accumulation of what will be termed herein Oxygen Toxicity Units (OTU). For purposes of the example, 300 is arbitrarily selected as the number of non-dimensional oxygen toxicity units allowable. Accordingly, for both single and daily oxygen toxicity limit calculation purposes, the oxygen toxicity unit accumulation rate or OTUR, can be established by simply dividing 300 by the allowable time. Thus, at an oxygen partial pressure of 1.0, OTUR can be established by simply dividing 300 by the allowable time. Thus, at an oxygen partial pressure of 1.0, OTUR is one unit per minute. In accordance with the invention, each value of $PO_2$ is associates with a corresponding OTU accumulation rate such that OTUR=OTUR ($PO_2$). As a dive progresses, allowable OTU will decrease, and if the dive enters a decompression regime, the OTU accumulation rate will increase as the necessary OTU's required for a minimum decompression time are set aside. The pulmonary time limit, Taxu, of the dive may be expressed as:

$$T_{OTU}=(OTU_{REMAINING}-OTU_{DEC})/OTUR(P_{O_2}) \qquad \text{EQUATION 15}$$

where $OTU_{REMAINING}$ represents oxygen toxicity units still available to a diver, $OTU_{DEC}$ represents the oxygen toxicity units set aside for any decompression regime and OTUR ($PO_2$) represents the oxygen toxicity unit accumulation rate at a particular chosen value of $PO_2$.

The capacity limited, $T_{CAP}$, which must also allow for gas consumption during decompression, may be expressed in pertinent part as:

$$T_{CAP}=V_{CAP}/O_2 \quad \text{EQUATION 16}$$

where $V_{cap}$ is the remaining volumetric capacity of the oxygen tank as indicated by tank pressure, and $O_2$ is the volumetric flow rate which for a closed circuit system is equal to the rate of oxygen consumption. One possible value of $PO_2$ for a particular dive is obtained when the pulmonary time limit $T_{OTU}$ is equated to the capacity limited time, $T_{CAP}$, or:

$$OTUR(P_{O_2})=(OTU_{REMAINING}-OTU_{DEC})/(V_{CAP}/O_2) \quad \text{EQUATION 17}$$

for which there is unique solution for $PO_2$.

The second candidate for the choice of $PO_2$ is achieved by equating the no-decompression time to the capacity limited time. No D times can be calculated using a number of different theories, the most common of which are based on the work of John Scott Haldane (1908). This theory models the human body as though it consisted of a number (typically between 5 and 12) of tissues, each having a different time scale and allowable nitrogen tension upon surfacing. This theory can be expressed by the following differential equation:

$$dN_i/dt=(D-N_i)/\tau_i \quad \text{EQUATION 18}$$

where D is the depth, $N_i$ is a measure of the nitrogen tension in units of feet of sea water, $\tau_i$ is the "halftime," in units of minutes, and the subscript $0_i$ refers to any one of the tissues of the model. Typical values of $\tau_i$ range from 5 to 480 minutes.

For gasses that have a variable oxygen content, the equivalent depth that must be used for the calculations, commonly referred to as the Equivalent Air Depth, is a function of both depth and $PO_2$, and $$EAD=33[(P_{AMB}-P_{O_2})/.79-1] \quad \text{EQUATION 19}$$

where EAD has units of feet of sea water, $P_{AMB}$ and $PO_2$ have units of atmospheres. By way of example, if D=99 feet, and the gas were air, $P_{AMB}$=4, $PO_2$=0.84, and EAD=D=99 feet. However, if the gas were oxygen rich, e.g., $PO_2$=1.4, EAD=76 feet., which would result in an increased NoD time. The formula for remaining NoD time is $$NoD=\text{Minimum}\{\tau_i \text{Ln}[(EAD-N_i)/(EAD-NC_i)]\} \quad \text{EQUATION 20}$$

where Ln is the natural logarithm, i.e., Ln(2)=0.693.

Thus at any time during the dive, the NoD time is a function of the previous dive profile as reflected in the present value of N, the depth as reflected in the present value of $P_{AMB}$, and of course $PO_2$ .

By equating this time to the capacity limited time, one can solve for the second choice of an optimum value of $PO_2$.

$$NoD(P_{O_2})=T_{CAP} \quad \text{EQUATION 21}$$

The optimum $PO_2$ is the minimum of the two choices found by solving Equations 16 and When any N>NC, decompression is required and Equation 20 may be used to calculate decompression times by simply replacing the minimum with the maximum of the expression indicated.

In practical terms, if the solution is found to be less than 0.5, value of $PO_2$ is set equal to 0.5 because lower values of $PO_2$ contribute no additional oxygen toxicity units, and all other factors being equal, a higher value of $PO_2$ is preferable. On the other hand if both choices exceed 1.6, 1.6 is chosen in order to avoid CNS oxygen toxicity. These $PO_2$ values are, of course, calculated in situ by a suitable signal processing circuit operating on data provided by an oxygen sensor, an ambient pressure (depth) guage, a tank capacity indicator (pressure guage), and firmware programmable NoD and oxygen toxicity accumulation schedules, as bounded by the upper and lower limits of $PO_2$ as mentioned previously. In situ calculations provide for real-time adaptability of oxygen partial pressures with respect to the dynamic nature of a typical dive. In particular, the effects of a constantly changing depth can be taken into account in accordance with the invention, with suitable $PO_2$ values being constantly recalculated and dynamically provided to the diver. Thus, at any point during a dive the $PO_2$ value being delivered to a diver is optimized so as to maximize bottom time while accounting for any required decompression and the accumulation of oxygen toxicity units.

In summary, although certain embodiments of the invention, i.e., a semi-closed circuit rebreather system, do not require an oxygen sensor, certain performance benefits may be obtained by embodiments of the invention that include such an oxygen sensor. Performance enhancements are obtained by taking into account the reduced nitrogen content of the breathing mixture and the advantageous effect this has on no-decompression times of a dive. In addition, an oxygen sensor can be used to establish a more restrictive range of oxygen consumption for a particular diver, which results in substantially reduced flow rates, longer dive times and thus, greater efficiency.

Moreover, the closed circuit embodiment of the present invention functions in terms of a calculated discrete value of oxygen partial pressure. However, an alternative design is able to use the same rules developed for the semi-closed circuit embodiment but with the limits on oxygen partial pressure greatly reduced and centered about the value calculated in accordance with the closed circuit algorithm and the limits on oxygen consumption substantially reduced and centered about the value calculated by an oxygen sensor. While the semi-closed circuit rebreather system exhibits a capacity decrease as $PO_2$ increases, thus leading to a more sensitive dependence of dive time on $PO_2$, the rules developed for determination of $PO_2$ for the closed circuit rebreather remain applicable for the semi-closed circuit system.

Figure 11:
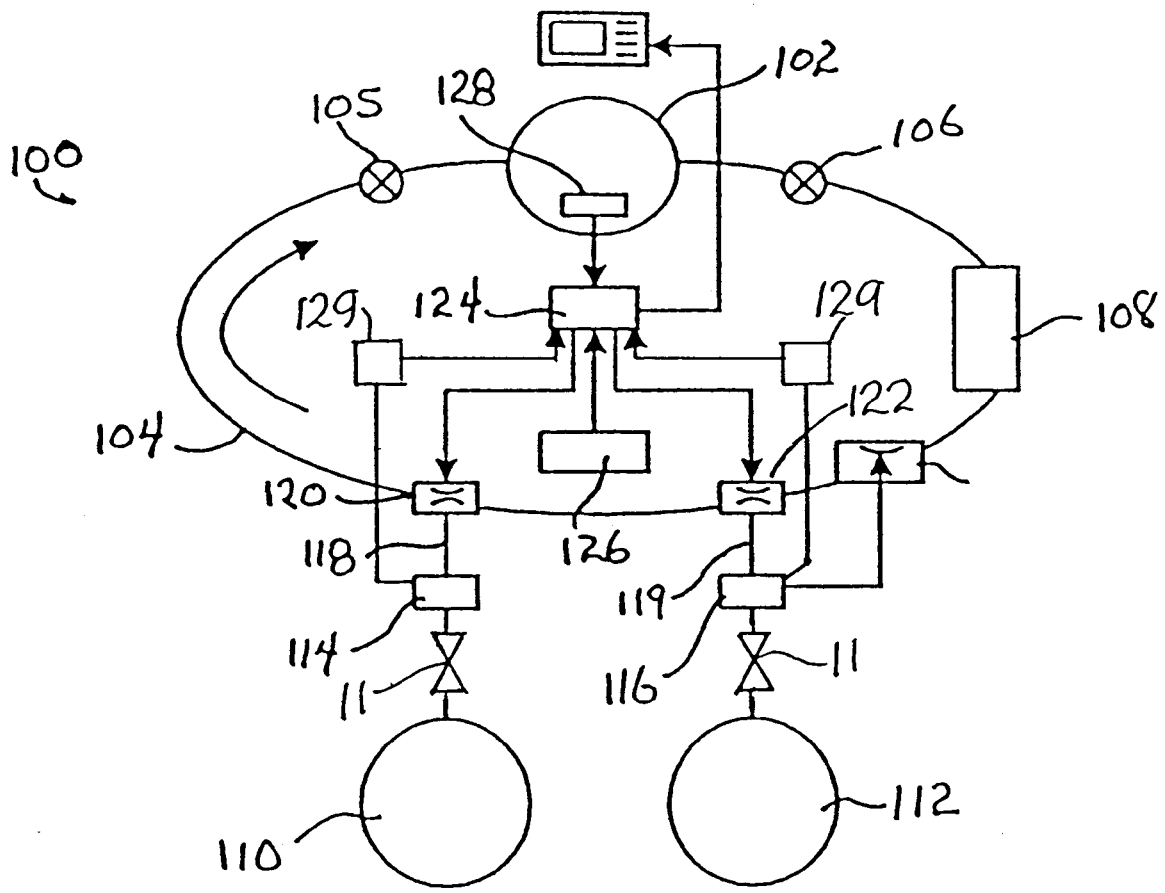
FIG. 11 is a semi-schematic generalized block level diagram of a closed circuit rebreather system in accordance with practice of principles of the invention.

A particular embodiment of a closed circuit rebreather system, capable of operation in accordance with principles of the invention described above, is depicted in FIG. 11. The components of the closed circuit rebreather system of FIG. 11 are substantially the same as the components of the semi-closed circuit rebreather system, in accordance with the invention, as depicted in FIG. 4, but with the addition of a tank pressure indicator 129 coupled to the supply tank and an oxygen sensor 128 provided within the counterlung 102. The oxygen sensor 128 and pressure indicator 129 are electronically coupled to the signal processing circuit 124 and provide the signal processing circuit with information relating to the partial pressure of oxygen comprising the gas within the counter lung and a figure of merit corresponding to the remaining capacity of the tank. It is, of course, axiomatic that the signal processing circuit 124 be one of a type capable of performing the calculations in accordance with the algorithm of the present invention, so as to develop and maintain a suitable oxygen partial pressure and deliver breathing gas comprising that optimal partial pressure to the diver through the counterlung.

Oxygen sensor 128, like the signal processing circuit 124 and pressure transducer 126, is implemented as any one of a number of conventional, commercial available oxygen sensors, as would be understood by one having skill in the art. Various oxygen sensor designs are prevalent throughout the field and are a mandatory component to the functioning of conventional closed circuit rebreather systems.

Reliable closed and semi-closed rebreather systems have been disclosed which operate in accordance with an algorithm to adaptively control oxygen and diluent gas flow rates as a function of depth, so as to maximize a diver's bottom time while taking deleterious physiological effects into account. The embodiments described above, diving depth, as defined by ambient pressure, has been used as the primary determinant of gas flow rates, with relatively wide extremes of oxygen consumption rates setting boundary conditions upon flow rate calculations. As will be evident to those having skill in the art, arbitrarily determined boundary conditions can be significantly scaled down by monitoring and recording a particular diver's oxygen consumption profile for example, the resulting extremes of which may be substituted into the algorithm of the invention in order to further refine the flow rate calculations and firer increase bottom time.

It will be recognized by those skilled in the art that various modifications may be made to the various preferred and other embodiments of the invention described above, without departing from the broad inventive scope thereof. It will be understood, therefore, that the invention is not limited to the particular embodiments, arrangement or steps disclosed, is rather intended to cover any changes, adaptations or modifications which are within the scope and spirit of the invention as defined by the appended claims.

What is claimed is:

1. A rebreather system of the closed circuit-type comprising a flow loop including a counterlung, the rebreather system comprising:

a breathing gas supply source;

a pressure regulator, coupled between the breathing gas supply source and the flow loop;

a mass flow controller for controlling the flow rate of the breathing gas to the flow loop, coupled between the pressure regulator and the flow loop, the mass flow controller having a variable flow rate;

a pressure transducer for indicating depth as a function of ambient pressure;

a breathing gas source capacity indicator;

an oxygen sensor; and a digital signal processing circuit, configured to receive data from the pressure transducer, the gas source capacity indicator and the oxygen sensor, the digital signal processing circuit being firmware programmed to perform calculations on said data and further programmed to perform calculations on data input by a user including whole body oxygen toxicity time limits, and no-decompression time limits, so as to define an oxygen partial pressure within the rebreather's counterlung which maximizes bottom time and no-decompression time, while minimizing accumulated whole body oxygen toxicity time.

2. The rebreather according to claim 1, wherein the signal processing circuit calculates a first oxygen partial pressure for the case where breathing gas source capacity limited time is equal to a determined no-decompression time, the signal processing circuit further calculating a second oxygen partial pressure for the case where breathing gas source capacity limited time is equal to a remaining whole body oxygen toxicity limited time.

3. The rebreather according to claim 2, wherein the signal processing circuit is further adapted to determine a minimum of the calculated first and second oxygen partial pressures, the signal processing circuit further adjusting the mass flow controller so as to condition the breathing gas source to supply breathing gas at an oxygen partial pressure equal to said minimum.

4. The rebreather according to claim 3, wherein the signal processing circuit calculates the first and second oxygen partial pressures at periodic intervals throughout the course of a dive, the signal processing circuit defining the minimum of the periodically calculated first and second oxygen partial pressures so as to dynamically adjust the oxygen partial pressure within the rebreather's counterlung in order to maximize bottom time.

5. The rebreather according to claim 3, wherein the breathing gas source further comprises:

a first, oxygen rich gas source having a first oxygen fraction, $FO_2$;

a second diluent gas source having a second oxygen fraction, $F_{AIR}$; and wherein the mass flow controller comprises first and second mass flow controllers; coupled respectively to the first oxygen rich gas source and the second diluent gas source, the first and second mass flow controllers individually adjustable for controlling gas flow from their respective sources to the counterlung.

6. The rebreather according to claim 5, wherein, the first and second mass flow controllers comprise electronically controlled valves, configured to receive control signals from the signal processing circuit and operative in response thereto, the first and second mass flow controllers adaptively adjustable so as to vary oxygen partial pressures in the counterlung in accordance with commands received from the signal processing circuit.

7. A method for adaptively configuring oxygen partial pressures in a rebreather system of the closed circuit-type, comprising a breathing gas source configured to provide a breathing gas mixture at variable oxygen partial pressures to a flow loop including a counterlung, to maximize dive time while minimizing decompression time and whole body oxygen toxicity acquired time, the method comprising;

defining a first time limit depending on a capacity of a breathing gas source tank;

calculating a second time limit depending on a no-decompression time at depth as a function of oxygen partial pressure;

calculating a third time limit depending on a whole body oxygen toxicity rate accumulation as a function of oxygen partial pressure;

determining a first oxygen partial pressure for the case in which the first capacity limited time is equal to the second no-decompression time;

determining a second oxygen partial pressure for the case where the first capacity limited time is equal to the third whole body oxygen toxicity limited time; and defining an optimum value of oxygen partial pressure so as to maximize dive time while minimizing decompression time and whole body oxygen toxicity accumulation.

8. The method according to claim 7, wherein the optimum oxygen partial pressure is equal to the lessor of the first and second determined oxygen partial pressures.

9. The method according to claim 8, further comprising:

providing an oxygen sensor; and providing a signal processing circuit configured to perform calculations, the signal processing circuit coupled to a mass flow controller and providing control signals to said mass flow controller, the signal processing circuit adaptively adjusting said mass flow controller so as to maintain oxygen partial pressure in the rebreather system at the optimum value.

10. The method according to claim 9, wherein the signal processing circuit determines the first and second oxygen partial pressures at periodic intervals throughout the course of the dive, the signal processing circuit defining an optimum value of oxygen partial pressure for each determination and adaptively adjusting the mass flow controller so as to dynamically maintain oxygen partial pressure in the rebreather at an instantaneous optimum value.

11. The method according to claim 10 further comprising:

defining a first, minimum, oxygen consumption value, $O_2^{MIN}$;

defining a second, maximum oxygen consumption value, $O_2^{MAX}$, to thereby define a parametric boundary space; and adaptively adjusting the mass flow controller so as to vary the breathing gas flow rate in a manner solely dependent on ambient pressure expressed as a function of diving depth.

12. The method according to claim 11 further comprising:

calculating and recording an oxygen consumption rate, as measured by the oxygen sensor, the signal processing circuit defining a maximum and minimum oxygen consumption rate for a diver under actual conditions; and adaptively adjusting the mass flow controller so as to deliver breathing gas to the rebreather at the optimal oxygen partial pressure in a manner dependent upon depth and the minimum and maximum calculated oxygen consumption rates.

13. A rebreather system comprising:

a breathing gas supply source;

a flow controller configured to control a flow rate of breathing gas from the breathing gas supply source;

a pressure transducer for measuring ambient pressure;

an oxygen sensor; and a signal processing circuit configured to receive an input from the pressure transducer and an input from the oxygen sensor, the signal processing circuit being programmed to use the input from the pressure transducer and the input from the oxygen sensor to define an oxygen partial pressure which enhances bottom time.

* * * * *